United States Patent [19]

Heyman

[11] Patent Number: 4,911,062

[45] Date of Patent: Mar. 27, 1990

[54] IMPACT TOLERANT MATERIAL

[75] Inventor: Joseph S. Heyman, Williamsburg, Va.

[73] Assignee: The United States of America as represented by the Administrator of the National Aeronautics and Space Administration, Washington, D.C.

[21] Appl. No.: 323,236

[22] Filed: Mar. 15, 1989

Related U.S. Application Data

[63] Continuation of Ser. No. 938,361, Dec. 4, 1986, abandoned, which is a continuation of Ser. No. 582,493, Feb. 22, 1984, abandoned.

[51] Int. Cl.[4] ..... F41H 5/04

[52] U.S. Cl. ..... 89/36.02; 181/286; 181/290

[58] Field of Search ..... 89/36.02; 428/911, 141, 428/142, 148, 191; 109/80, 82, 83, 84, 85; 181/207, 208, 286, 290, 294

[56] References Cited

U.S. PATENT DOCUMENTS

| | | | |
|---|---|---|---|
| 2,039,372 | 5/1936 | Wickmann | 428/148 |
| 2,391,353 | 12/1945 | Sheridan | 428/682 |
| 3,243,374 | 3/1966 | Gillard | 181/286 |
| 3,592,147 | 7/1971 | Harper | 109/80 |
| 3,634,177 | 1/1972 | Glaser | 89/36.02 |
| 3,771,418 | 11/1973 | Gulbierz et al. | 89/36.02 |
| 3,864,146 | 2/1975 | Oda et al. | 346/211 |
| 3,894,169 | 7/1975 | Miller | 181/207 |
| 4,048,365 | 9/1977 | Hoover | 428/215 |
| 4,179,979 | 12/1979 | Cook et al. | 428/247 |
| 4,234,331 | 11/1980 | Gray et al. | 427/168 |
| 4,251,251 | 2/1981 | Blankenship | 65/110 |
| 4,257,998 | 3/1981 | Diepenbrock, Jr. et al. | 181/286 |
| 4,300,439 | 11/1981 | Degnan et al. | 92/146 |
| 4,312,902 | 1/1982 | Murase et al. | 138/146 |
| 4,418,984 | 12/1983 | Wysocki et al. | 427/163 |
| 4,420,526 | 12/1983 | Schilling et al. | 181/294 |
| 4,425,161 | 1/1984 | Shibahashi et al. | 427/150 |
| 4,521,475 | 6/1985 | Riccio et al. | 428/142 |
| 4,704,943 | 11/1987 | McDougal | 89/36.02 |

FOREIGN PATENT DOCUMENTS

| | | | |
|---|---|---|---|
| 2851429 | 12/1979 | Fed. Rep. of Germany . | |
| 2851429 | 12/1979 | Fed. Rep. of Germany . | |
| 1467811 | 3/1977 | United Kingdom | 181/286 |

*Primary Examiner*—Deborah L. Kyle
*Assistant Examiner*—Stephen Johnson
*Attorney, Agent, or Firm*—Harold W. Adams; John R. Manning; Charles E. B. Glenn

[57] ABSTRACT

A material 11 is protected from acoustic shock waves generated by impacting projectiles by means of a backing 12. Backing 12 has an acoustic impedance that efficiently couples the acoustic energy out of the material 11.

1 Claim, 2 Drawing Sheets

IMPACT TOLERANT MATERIAL

This application is a continuation of application Ser. No. 938,361 now abandoned filed Dec. 4, 1986, which is a continuation of application Ser. No. 582,493 now abandoned, filed 2/22/84.

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

The invention relates generally to structures and materials having improved tolerance to impact damage and more specifically concerns reducing the damage done to materials by the shock waves produced by impacting projectiles.

Most attempts to improve the impact damage tolerance of graphite fiber reinforced epoxy matrix composites have worked with new resins, new curing techniques, or new fiber types and orientations. In addition, novel structural geometries have been introduced which are themselves damage tolerant in that material damage/failure at a point of impact is not catastropic to the entire structure.

While these attempts to improve material properties and structural insensitivity have been quite successful, they have not included a major factor in high velocity damage—the damage done by the acoustic shock wave generated by the impacting projectile. By not including the correct physical acoustic model, optimum use of given materials and structural designs have been wanting.

It is therefore the primary object of this invention to reduce the damage done to materials and structural designs by acoustic shock waves generated by impacting projectiles.

Another object of this invention is to utilize the correct physical acoustic model to obtain optimum use of materials and structural designs in impacting projectile environments.

A further object of this invention is to provide a backing for materials and structural design that has an acoustic impedance which couple acoustic shock waves out of the materials or structural design and thereby reduce the damage done by shock waves generated by impacting Still another object of the invention is to improve the impact tolerance of multiple lamina materials with acoustic impedance variations through the lamina thicknesses.

Other objects and advantages of this invention will become apparent hereinafter in the specification and drawings.

SUMMARY OF THE INVENTION

The invention comprises a backing for materials that are subjected to impacting projectiles. The backing couples the acoustic energy out of the material thereby reducing the high strain gradient which would be present at the back of the material if the backing were not used. In a first embodiment of the invention the backing has an acoustic impedance of $Z_C$ which is the acoustic impedance of the material. In a second embodiment the acoustic impedance of the backing is $Z_T=\sqrt{Z_C Z_A}$ where $Z_A$ is the acoustic impedance of the medium surrounding the material; and in a third embodiment the acoustic impedance of the backing is $Z_C$ where it is in contact with the material and monotonically decreases to a nominally low value.

DETAILED DESCRIPTION OF THE INVENTION

Figure 1:
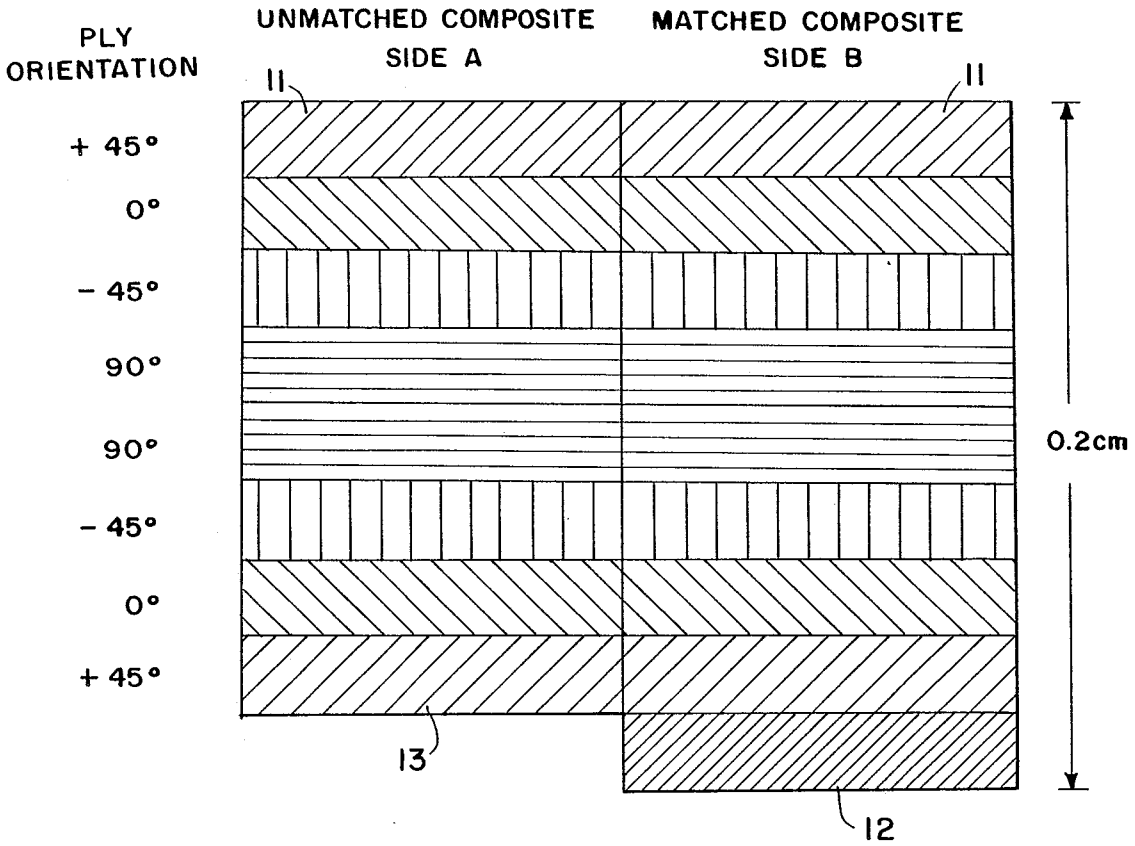
FIG. 1 is a schematic drawing of an unmatched material (Side A) and the material matched (Side B) with a backing in accordance with this invention.

This invention discloses the important aspect that the acoustic wave plays in impact damage and selects a process which significantly improves a given material's impact tolerance. When an impact occurs, a high amplitude acoustic wave is launched from the point of contact. The velocity of the acoustic wave can be written as:

$$V=\sqrt{M/\rho} \tag{1}$$

where M is a compressional modulus and $\rho$ a density. The engineering modulus is generally considered derived from a Hookian law such that the elastic restoring force F, equals a constant times a strain: $F=M\epsilon$ where M is the elastic constant (a modulus) and $\epsilon$ is the strain.

For small amplitude strains, this treatment is acceptable and has been used extensively for linear elastic material behavior. However, the conditions of impact produce large amplitude strains. The general Hooks law is no longer a sufficiently complete description of the acoustic wave propagation. It is now necessary to include higher order terms such as:

$$F=M_2\epsilon+M_3\epsilon^2+M_4\epsilon^3+\ldots \tag{2}$$

As an example, consider the first higher order term. We can write:

$$F=(M_2+M_3\epsilon)\epsilon=\overline{M}\epsilon \tag{3}$$

where $\overline{M}$ is now a function of strain and thus is no longer a constant. The implications of this are significant. Consider the acoustic velocity from equation (1) which now becomes a function of strain. Thus, an acoustic wave velocity depends on spatial strain field set up by the wave itself.

This results in a shock wave formation—a sharp gradient in strain with respect to position. As the wave propagates the higher amplitude lower frequency components undergo harmonic generation, shifting the propagating energy wave to higher frequencies. At some point, the energy lost by attenuation equals the energy harmonically generated from the propagating wave and an equilibrium shock wave propagates at the strain stiffened velocity.

A major damage mechanism occurs when the shock wave is reflected. This can occur either at a material boundary or within the material wherever the acoustic impedance $Z_C=\rho V$ of the material changes. At such a boundary a reflected wave is generated with a simplified reflection coefficient:

$$R = \frac{Z_A - Z_C}{Z_C + Z_A} \quad (4)$$

where $Z_A$ is the acoustic impedance beyond the boundary outside the material. If $Z_A < Z_C$ the reflected wave has an opposite strain sign so that at the instant of reflection, a significant strain gradient occurs at or near the reflecting boundary. If the gradient exceeds the material strength at that point, delamination, disbonding, or material failure occurs caused by the high strains and momentum transfer. For a plate with effective clamped boundaries, large plate modes also occurs after the shock wave has done its initial damage. The shock damaged material is weaker than the surrounding media and can be failed more easily under buckling loads induced by the large plate modes.

Using this acoustic model of the impact damage, several modifications to the existing composite design will improve its impact tolerance.

The most straightforward design modification is shown in FIG. 1. A cross-section of a composite plate is illustrated on the lefthand side of the FIG. The plate is an epoxy/graphite (G/E) fiber design with eight unidirectional laminated plys. More typical, the stack sequence is varied to modify the strength/strength anisotropy such as $(\pm 45°, 90, 0)_s$ the subscript s indicates a symmetric sequence for the other four lamina. The righthand part of FIG. 1 shows the composite 11 modified to improve the material impact tolerance. At the back free boundary, a Z-match layer 12 of acoustic matching material with an impedance $Z_M = Z_C$ is intimately coupled to the material. This couples the acoustic energy out of the composite reducing the high strain gradient and momentum transfer which would occur at the unmatched back layer 13.

The Z-match layer can be thick or thin, depending on the service it is expected to serve. For a thin layer where the shock wave may reflect off the back of the Z-match, it is advisable to corrugate the Z-match back layer. The irregular surface will disperse the shock wave further reducing any strain gradients.

To match the acoustic impedance, the Z-match layer should have the impedance of the composite backface under shock loading. A mixture of epoxy with chopped carbon fibers is a compatible match for the G/E systems. For laboratory tests, other Z-match layers were investigated including wax, thermoplastic bonding glues, pitch, clays, and phenyl salicylate all doped with tungsten powders and/or aluminum oxide powders.

Figure 2:
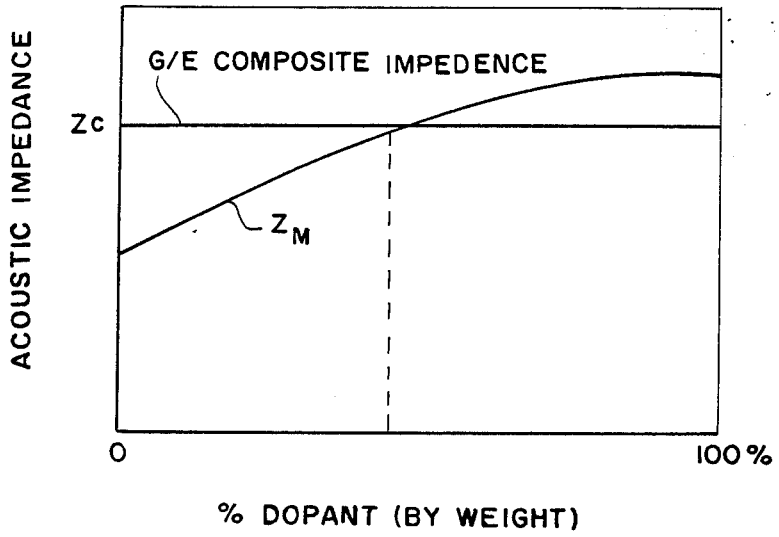
FIG. 2 is a graph for explaining how the backing can be made to have an acoustic impedance $Z_C$.

A close Z-match is possible by varying the percent dopant in the back layer matrix material to achieve a graph similar to that shown in FIG. 2. The impedance of the matrix layer is $Z_M$ and must be raised to the vicinity of $Z_C$, the G/E composite impedance. Depending on the G/E behavior under shock, $Z_M$ may actually have to be raised to a value greater than $Z_C$ to account for the shift in $Z_C$ under shock loading if perfect boundary conditions are to be achieved.

For the tests reported below, phenyl salicylate was doped with aluminum oxide and melted onto a G/E 8-ply composite. The measured values of the Z-match layer was within five percent of the $Z_C$ value determined from acoustic reflection coefficient measurements. The sample was impacted with a 2.54 cm (1.0 inch) diameter steel ball dropped from a height of 183 cm (72 inches). The sample was 10 cm (4 inches) wide, 35 cm (14 inches) long, and 0.2 cm (0.07 inch) thick rigidly clamped in a rectangular frame with a rectangular opening.

The identical impacts on the composite resulted in damage to both side A and side B. The rebound of the ball on side A (unmatched) was 125 cm (50 inches) or about 70% of the initial drop height. On the B side (Z-matched) the rebound was 43 cm (17 inches) or about 25% of the initial drop height. The shock wave was coupled into the Z-match layer and thus could not interact with the ball just after impact. The energy lost to the Z-match layer could not damage the composite.

An ultrasonic "C" scan of the impacted plate was made which represents an acoustic parallel to an x-ray showing regions of damage by their change in acoustic properties. The size of the damage zone of the two impacts showed significantly the improved properties of the Z-matched side.

For a practical material backing, the bulk back layer disclosed above adds a significant weight penalty which for some structures may be prohibitive. For these cases, an acoustic back layer may be fabricated as a transmission or T-match layer having an acoustic impedance $Z_T$. The reflection coefficient is zero for a layer of material $\frac{1}{4}$ of the acoustic wavelength in thickness and of impedance $Z_T = \sqrt{Z_C Z_A}$ where $Z_C$ is the acoustic impedance of the G/E composite and $Z_A$ the acoustic impedance of the surrounding media (air, liquid or solid). The T-match will couple shock wave energy out of the composite into the air (liquid or solid) in a bandwidth determined by the T layer 12 and the frequency spectra of the shock wave itself.

Figure 3:
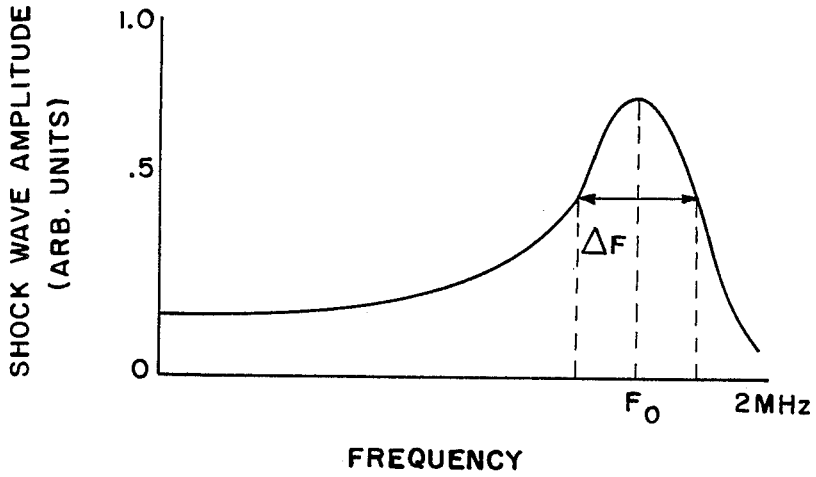
FIG. 3 is a graph for explaining how the T-match backing operates.

For example, in FIG. 3, the spectrum of a hypothetical shock propagating in a composite is shifted to the higher frequencies resulting from the nature of a shock and harmonic generation effects. A quarter wave plate centered at $F_o$ will couple the majority of the shock energy in the bandwidth $\Delta F$ to the $Z_A$ medium. The energy able to damage the plate is significantly reduced at a cost of the weight of the $Z_T$ layer. But $Z_T$ is a quarter wave plate at nearly 2 MHz or about 0.04 cm (0.015 inch) thick with an impedance of the geometric mean of the composite and air of about $4 \times 10^3$ Rayl. The density of such a medium is less than 0.1 g/cm$^3$ for a negligible weight penalty.

The T-match thickness depends on the acoustic spectra of the shock wave which in turn depends on the material nonlinear properties and attenuation. T-match layers are thus tailored to the material they serve varying in density/thickness. For a composite, a T-match to air for a practical application are a sprayed epoxy mixed with very low density material such as hollow glass beads of size diameter $D << \lambda$. This is a low cost, low mass, passive impact shock wave coupling layer.

A third embodiment of the acoustic approach to improved shock tolerance is a gradient or G-match layer 12. In this approach, the material in contact with the G/E composite has a $Z = Z_C$. However, within one or two $\lambda$, Z decreases monotonically to a nominally low value. The result of this geometry is to diffuse the sharp reflection gradient into a smooth transition over a longer pathlength. Thus, the local gradient at any one point is reduced.

Finally, there are interlaminar impedance mismatches which can be reduced by this technique. FIG. 1 shows 8-layers of fiber reinforced epoxy. At the surface of each lamina is a resin rich region. When the lamina are stacked, alternating resin rich, and normal sections occur. To reduce shock reflections between lamina, the laminating process is modified. A thin fiber rich layer is incorporated between lamina. This can be easily accomplished by sprinkling chopped fibers on each lamina during lamina stacking. During curing, thes fibers will produce a uniform acoustic impedance between lamina. In addition, the fibers will provide additional resistance to interlamina cracking.

The advantage of this invention is that it provides a simple inexpensive means for decreasing the damage done to materials by acoustic shock waves whenever the materials are impacted by projectiles.

It is to be understood that the form of the invention herewith shown and described is to be taken as a preferred embodiment. Changes may be made without departing from the invention. For example, the invention is not limited to composites: metals, ceramics, etc., may be protected by this invention.

What is claimed is:

1. A method of improving the impact tolerance of a composite elastomer matrix material having a front surface exposed to an impacting projectile and a shock load resulting therefrom and a back surface, said composite elastomer matrix material having an acoustic impedance $Z_c$ under said shock load resulting from said impacting projectile comprising the step of:

forming a layer of shock protecting material on the back surface of said composite elastomer matrix material by melting phenyl salicylate doped with aluminum oxide thereon, said layer of shock protecting material having an acoustic impedance $Z_m$ matching said acoustic impedance $Z_c$.

* * * * *